US005639121A

United States Patent [19]

Montoya

[11] Patent Number: 5,639,121

[45] Date of Patent: Jun. 17, 1997

[54] DEVICE FOR RETAINING A SKI, ESPECIALLY IN DEEP SNOW

[76] Inventor: Pierre Montoya, Les balcons de Gairault, 36 Vieux Chemin de Gairault 06100 Nice, France

[21] Appl. No.: 464,812

[22] PCT Filed: Dec. 20, 1993

[86] PCT No.: PCT/FR93/01269

§ 371 Date: Jun. 20, 1995

§ 102(e) Date: Jun. 20, 1995

[87] PCT Pub. No.: WO94/14508

PCT Pub. Date: Jul. 7, 1994

[30] Foreign Application Priority Data

Dec. 21, 1992 [FR] France ..... 92 15808

[51] Int. Cl.[6] ..... A63C 9/00

[52] U.S. Cl. ..... 280/809; 280/637

[58] Field of Search ..... 280/619, 620, 280/621, 637, 809, 816, 818; 348/488

[56] References Cited

U.S. PATENT DOCUMENTS

| | | | |
|---|---|---|---|
| 1,856,547 | 5/1932 | Gotthardt | 384/488 |
| 5,324,063 | 6/1994 | Locantro | 280/809 |

FOREIGN PATENT DOCUMENTS

| | | | |
|---|---|---|---|
| 2419088 | 11/1979 | France | 280/619 |
| 3406170 | 8/1985 | Germany | 280/809 |
| 570180 | 12/1975 | Switzerland | 280/637 |
| 89/04194 | 5/1989 | WIPO | 280/637 |

*Primary Examiner*—Richard M. Camby
*Assistant Examiner*—Frank Vanaman
*Attorney, Agent, or Firm*—Donald J. Pagel

[57] ABSTRACT

A device for retaining a ski which has become detached in powder or deep snow. The device comprises a strap that links a ski boot to a winding apparatus mounted on the ski. The winding apparatus comprises two units each of which includes a spring positioned adjacent to a bearing unit. An elongated pin extends between the two units and the strap winds around the pin in the space between the two units. The bearing unit has an aperture extending through it and the pin extends through the aperture. Each end of the pin is attached to one of the springs.

10 Claims, 3 Drawing Sheets

DEVICE FOR RETAINING A SKI, ESPECIALLY IN DEEP SNOW

FIELD OF THE INVENTION

The invention relates to safety devices for recovering detached skis in powder or deep snow, and in particular a device for retaining a ski of the type comprising a strap connecting the ski boot to a winding means mounted on the ski.

BACKGROUND ART

So as to avoid losing skis during a fall, they were traditionally fitted with soft leather straps. This proved to be a good method but all the same dangerous for the skier who risked a serious accident if the fall was bad or violent.

The appearance of the device known as "stop-ski" consisting of a pin which is released when the skier loses a ski and which blocks the ski's progress in the snow, gave the skier total independence. Even so, "stop-ski" is ineffective in powder snow. However, over the last few years, skiing has developed a great deal and the skier who has achieved what he considers to be a high standard, will always be attracted by off-track skiing despite the fact that it is forbidden, dangerous and ill-advised. Another system used for recovering a detached ski comprises a winding means mounted on the ski and connected to the ski boot by a strap which unwinds yet holds the ski attached to the ski boot in the event of a fall. This system, although effective, generally lacks flexibility and is not always reliable in that the strap can become unattached from the winding means in the event of a violent fall, which can then lead to the ski being lost.

DISCLOSURE OF THE INVENTION

The object, therefore, of this invention is to provide a flexible and reliable device for avoiding the loss of a detached ski.

This invention consists thus of a device for avoiding the loss of a ski which has become detached in powder or deep snow of the type comprising a strap linking the ski boot to a winding means mounted on the ski, wherein the winding means comprises two units which are integral with the ski and are connected by a main pin about which is wound the strap. Each of the units comprises a spiral spring, the moveable end thereof being integral with said pin, so that, when the ski becomes detached, the strap is unwound, thereby linking the ski to the ski boot at a certain distance from the latter.

BRIEF DESCRIPTION OF THE DRAWINGS

The objects, features and objectives of the invention will be better revealed upon reading the following description given with references to diagrams wherein.

DETAILED DESCRIPTION

Figure 1A:
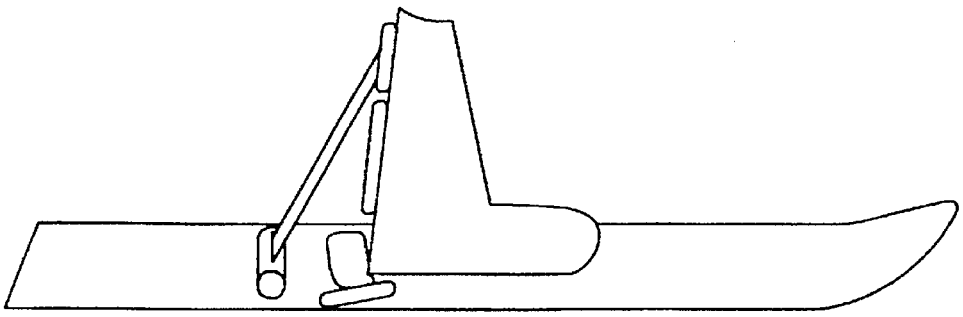
FIGS. 1*a* and 1*b* schematically represent the device according to the invention mounted on the ski, FIG. 1*a* showing the ski boot attached to the ski, and FIG. 1*b* showing the ski boot separated from the ski.
Figure 1B:
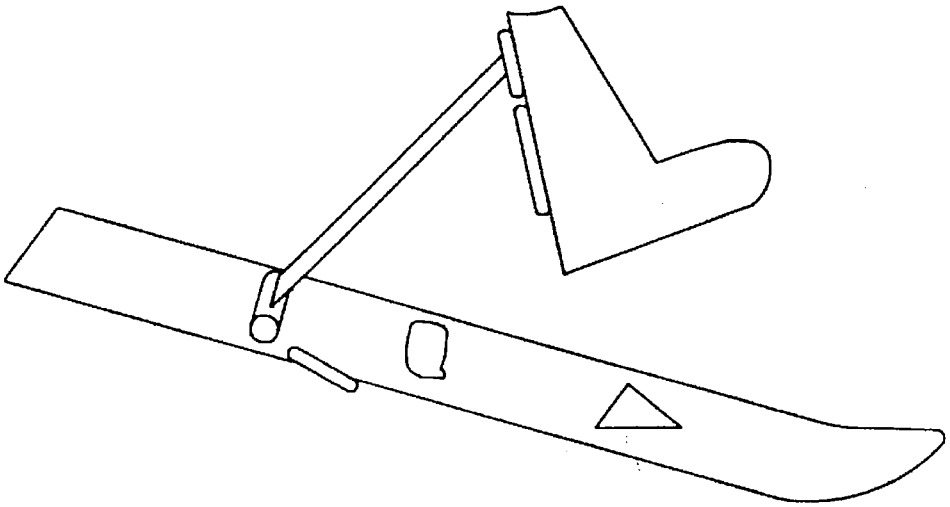

FIGS. 1*a* and 1*b* represent the device which is mounted on the ski behind the heel so that it is offset from the center of gravity of the ski. FIG. 1(*a*) illustrates the device when the ski is attached to a ski boot and FIG. 1(*b*) illustrates the device when the ski is detached from the ski boot.

Figure 2:
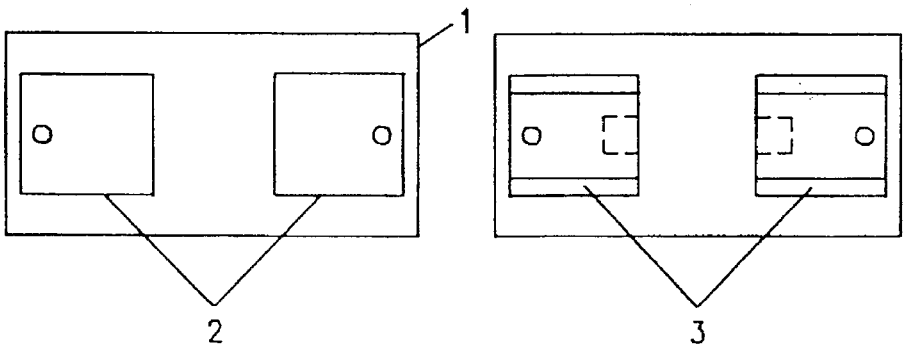
FIG. 2 represents the base on which are mounted the two units comprising the device according to the invention.

The base (1) represented in FIG. 2 can be made of any rigid material such as rigid plastic or light composite. Rectangular in shape, it comprises two hollow sites (2) at its ends where the two units (3) preferably made of alloy are positioned, thus enabling centering of the mechanism.

Figure 3:
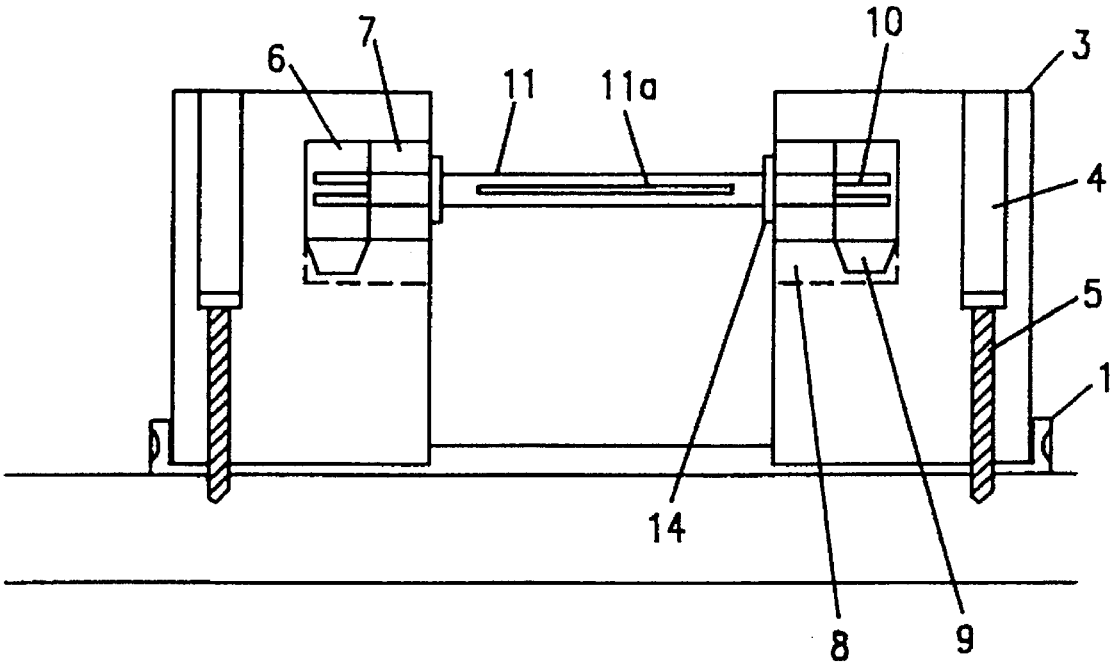
FIG. 3 is a cross section of the device according to the invention mounted on its base.

FIG. 3 represents the whole device. It is characterised by the two alloy units (3) which are generally rectangular in shape but which are slightly wider at the bottom than at the top. In the top of each unit, a hole with a diameter equal to that of a screw head (4) has been drilled halfway down to form a stop, and from the bottom of this chamber, a hole with the diameter of the screw (5) itself has been drilled down to the bottom. These two screws (5) keep the device and the base (1) in position on the ski.

Figure 4:
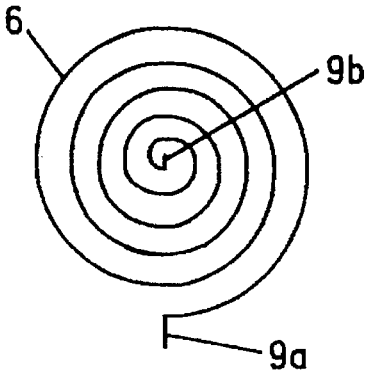
FIG. 4 represents the return spring used in each of the two units.
Figure 5:
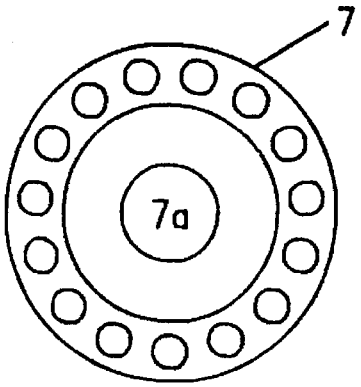
FIG. 5 is a cross section of one of the two bearings supported by the strap winding pin, FIG. 6 schematically represents the strap which is wound round the pin and projecting from the opening in the cover protecting the device according to the invention.

Each unit (3) has a hole with a diameter and depth of approximately 10 mm drilled facing the other to receive the springs (6), illustrated in FIG. 4, as well as the tight ball bearings (7), illustrated in FIG. 5 with a central opening (6*a*) of approximately 4 mm.

The drilled out holes have a groove (8) approximately 0.8 mm thick and 6 mm high to receive the fixed end (9*a*) of the spring (6) and to secure it.

It is to be noted that the spring used in preference is of the flat, spiral type which is set so that it has a resistance capacity equal to approximately 3 kg. It is, however, evident that any other equivalent spring or mechanism producing the same effect may be used.

The two bearings (7) in FIG. 5 have central openings (7*a*) through which a pin (11) passes with a groove at each end which is approximately 0.25 mm thick and 6 mm deep and into which the spring's (6) central moving strip (9*b*) (see FIG. 4) is introduced.

The pin (11) comprises a central groove (11*a*) approximately 15 mm long to secure the strap. Two retaining rings (14), between which the strap is wound, are set on said pin for the purpose of butting the two bearings against the springs and thus positioning the two alloy units at an equal distance so that they can be screwed on their base.

Figure 6:
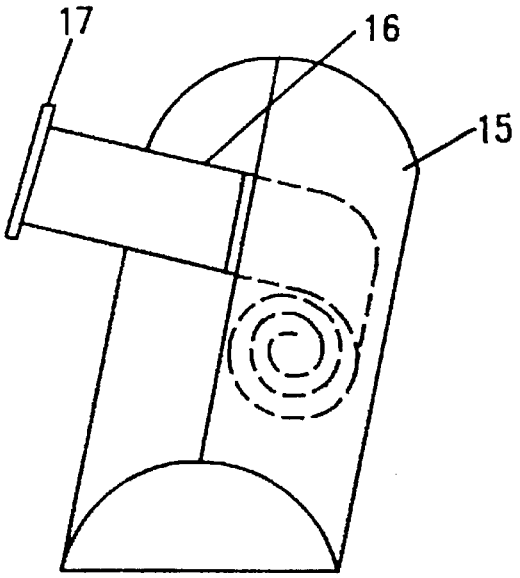

The strap (13) illustrated in FIG. 6, preferably in 1 mm thick twisted Nylon but which could be in any other material of the same strength, is fixed in the central groove of the pin (11) and is wound around the latter while being held in the cover (15) which protects the whole device. The strap (13) projects from the cover (15) through the slot (16). In order to connect it to the ski boot, the end of the strap is fitted with a rod (17) made of rigid plastic or composite, approximately 4 mm thick and 20 to 24 mm wide, which is, therefore, wider than the slot (16) enabling it to remain outside and to be used at will.

Figure 7:
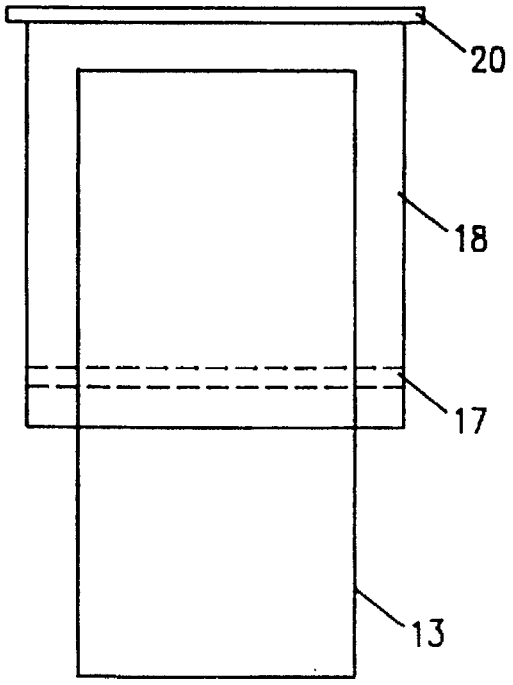
FIG. 7 represents a plan view of the box which is integral with the ski boot and wherein the end of the strap is fixed, FIG. 8 schematically represents the winding of the strap in the alternative version of the invention using two pins.

The rod (17) at the end of the strap (13) is intended to be placed in a small box-drawer assembly (18–20) represented in FIG. 7 riveted to the back of each ski boot. The rod is positioned in the central opening of the box (18). The entire assembly is factory cast to form one piece.

It is to be noted that the cover (15), generally semi-cylindrical in form and intended to protect the device, can be of rigid plastic or composite, forming one piece with the base. The joining of said two elements is tight. They may be secured with ordinary screws on the sides after first perforating the sides of the two alloy units, or by simple interlocking by concave and convex lugs respectively cast on the base and box.

One of the distinctive features of the device according to the invention is that its strap must be sufficiently long so that in the event of a fall or of a ski becoming detached, said ski is far enough away from the skier so as not to injure him should the fall be extended because of the slope. The strap must therefore be no less than 80 cm long. With a strap of 80 cm the number of turns around the pin connecting the two units is approximately 15, which represents a diameter of 32 mm when the strap is wound.

Figure 8:
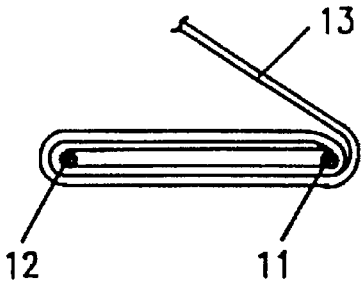

In order to dispose of the longest possible strap and the minimum amount of space and weight, a two pin winding means may be used as shown in FIG. 8, the first pin (11) which is fitted with a spiral spring at both ends and acts as the driving pin as in the device shown in the previous figures, while the second pin (12) acts only as a guiding pin. Winding the strap round two pins enables use of a much longer strap, for example 1.5 m, while reducing the height of the device in relation to the base.

Unlike the devices of former techniques using a single strap winder, the device of this invention enables the violent stress which may occur when a skier falls to be distributed over two springs. For the same desired tension, the springs have therefore half as much stress and better overall flexibility is obtained. Said flexibility can prevent the strap mounting from breaking which could occur with the single winding means used previously. Moreover, the effort exerted by the strap as it suddenly unwinds during a fall, is therefore constantly balanced over both ends of the pin, enabling great flexibility. Finally, the fact that the two units each have a spring considerably increases the reliability of the whole device in that even if one of the springs is broken, the device will continue to work because of the second spring.

I claim:

1. A device for keeping a ski in the proximity of a skier comprising:

a strap for connection to a ski boot;

an elongated pin connected to the strap, the elongated pin having a first end, a second end and a wrap section the strap being wound around the wrap section of the elongated pin;

a first spring means for exerting a first force on the elongated pin, the first force increasing when the strap is at least partially unwound from the elongated pin, thereby acting to rewind the strap around the elongated pin;

a second spring means for exerting a second force on the elongated pin, the second force increasing when the strap is at least partially unwound from the elongated pin, thereby acting to rewind the strap around the elongated pin:

a first ball bearing assembly positioned adjacent to the first spring means between the first spring means and the wrap section with no part of the first spring means circumscribing the first ball bearing assembly, the first ball bearing assembly having a first aperture which extends through the first ball bearing assembly; and a second ball bearing assembly positioned adjacent to the second spring means between the second spring means and the wrap section with no part of the second spring means circumscribing the second ball bearing assembly, the second ball bearing assembly having a second aperture extending through the second ball bearing assembly, the elongated pin extending through the first aperture and through the second aperture with the first end of the elongated pin being attached to the first spring means and the second end of the elongated pin being attached to the second spring means.

2. The device of claim 1 wherein the strap has a length of approximately eighty centimeters.

3. The device of claim 1 wherein the first spring means comprises a spiral spring.

4. The device of claim 1 wherein the first spring means comprises a spiral spring and the second spring means comprises a spiral spring.

5. The device of claim 1 further comprising:

a first housing unit that substantially surrounds the first spring means and which is adapted for connection to a ski; and a second housing unit that substantially surrounds the second spring means and which is adapted for connection to the ski.

6. The device of claim 1 wherein the strap includes a first strap end and a second strap end, and the first strap end is inserted in a groove positioned in the elongated pin.

7. A system for keeping a ski in the proximity of a skier comprising:

a ski;

a strap for connection to a ski boot;

a first elongated pin connected to the strap, the first elongated pin having a first end, a second end and a wrap section, with the strap being wound around at least part of the wrap section of the first elongated pin;

a first spring means for exerting a first force on the first elongated pin, the first force increasing when the strap is at least partially unwound from the first elongated pin, the first force thereby acting to rewind the strap around at least part of the first elongated pin;

a first housing unit substantially surrounding the first spring means with the first housing unit being secured to the ski;

a second spring means for exerting a second force on the first elongated pin, the second force increasing when the strap is at least partially unwound from the first elongated pin, the second force thereby acting to rewind the strap around at least part of the first elongated pin;

a second housing unit substantially surrounding the second spring means with the second housing unit being secured to the ski;

a first bearing assembly positioned adjacent to the first spring means between the first spring means and the wrap section with no part of the first spring means circumscribing the first bearing assembly, the first bearing assembly having a first aperture which extends through the first bearing assembly; and a second bearing assembly positioned adjacent to the second spring means between the second spring means and the wrap section with no part of the second spring means circumscribing the second bearing assembly, the second bearing assembly having a second aperture extending through the second bearing assembly, the first elongated pin extending through the first aperture and through the second aperture with the first end of the first elongated pin being attached to the first spring means and the second end of the first elongated pin being attached to the second spring means.

8. The device of claim 7 wherein the strap has a length of approximately eighty centimeters.

9. The device of claim 7 further comprising:

a second elongated pin positioned parallel to the first elongated pin with the strap being wound around the first elongated pin and the second elongated pin.

10. A system for keeping a ski in the proximity of a skier comprising:

a ski;

a strap for connection to a ski boot, the strap having a length of at least approximately eighty centimeters;

a first elongated pin connected to the strap, the first elongated pin having a first end, a second end and a wrap section, with the strap being wound around at least part of the wrap section of the first elongated pin;

a second elongated pin positioned parallel to the first elongated pin with the strap being wound around the wrap section of the first elongated pin and around the second elongated pin;

a first spring means for exerting a first force on the first elongated pin, the first force increasing when the strap is at least partially unwound from the first elongated pin, the first force thereby acting to rewind the strap around at least part of the first elongated pin;

a first housing unit substantially surrounding the first spring means with the first housing unit being secured to the ski;

a second spring means for exerting a second force on the first elongated pin, the second force increasing when the strap is at least partially unwound from the first elongated pin, the second force thereby acting to rewind the strap around at least part of the first elongated pin;

a second housing unit substantially surrounding the second spring means with the second housing unit being secured to the ski;

a first bearing assembly positioned adjacent to the first spring means between the first spring means and the wrap section with no part of the first spring means circumscribing the first bearing assembly, the first bearing assembly having a first aperture which extends through the first bearing assembly; and a second bearing assembly positioned adjacent to the second spring means between the second spring means and the wrap section with no part of the second spring means circumscribing the second bearing assembly, the second bearing assembly having a second aperture extending through the second bearing assembly, the first elongated pin extending through the first aperture and through the second aperture with the first end of the first elongated pin being attached to the first spring means and the second end of the first elongated pin being attached to the second spring means.

* * * * *